US006658681B2

(12) United States Patent
Britto et al.

(10) Patent No.: US 6,658,681 B2
(45) Date of Patent: Dec. 9, 2003

(54) POSITIONABLE PILLOW

(75) Inventors: James J. Britto, Westport, MA (US); Richard M. Foley, Medfield, MA (US)

(73) Assignee: The First Years, Inc., Lake Forest, CA (US)

( * ) Notice: Subject to any disclaimer, the term of this patent is extended or adjusted under 35 U.S.C. 154(b) by 0 days.

(21) Appl. No.: 10/126,046

(22) Filed: Apr. 19, 2002

(65) Prior Publication Data

US 2003/0196269 A1 Oct. 23, 2003

(51) Int. Cl.[7] ..... A47G 9/10
(52) U.S. Cl. ..... 5/655; 5/636; 5/640
(58) Field of Search ..... 5/655, 636, 640, 5/643

(56) References Cited

U.S. PATENT DOCUMENTS

| | | | | | |
|---|---|---|---|---|---|
| 2,961,668 | A | * | 11/1960 | Hayes | 5/640 |
| 3,327,330 | A | | 6/1967 | McCullough | 5/640 |
| 3,899,797 | A | * | 8/1975 | Gunst | 5/655.3 |
| 4,197,604 | A | | 4/1980 | Nakamura | 5/640 |
| 4,236,264 | A | | 12/1980 | Britzman | 5/640 |
| 4,617,691 | A | | 10/1986 | Monti et al. | 5/640 |
| 4,731,890 | A | | 3/1988 | Roberts | 5/655 |
| 4,790,042 | A | * | 12/1988 | Reich | 5/655 |
| 5,154,649 | A | | 10/1992 | Pender | 5/655 |
| 5,261,134 | A | | 11/1993 | Matthews | 5/655 |
| 5,313,678 | A | | 5/1994 | Redewill | 5/639 |
| 5,371,909 | A | * | 12/1994 | McCarty | 5/655 |
| 5,385,153 | A | | 1/1995 | Jamieson et al. | 5/640 |
| 5,519,906 | A | | 5/1996 | Fanto-Chan | 5/631 |
| 5,546,620 | A | | 8/1996 | Matthews | 5/655 |
| 5,581,833 | A | | 12/1996 | Zenoff | 5/655 |
| 5,596,780 | A | * | 1/1997 | Brenn | 5/643 X |
| 5,661,861 | A | | 9/1997 | Matthews | 5/633 |
| 5,768,725 | A | * | 6/1998 | Brenn | 5/643 X |
| D413,751 | S | | 9/1999 | Alyea | D6/601 |
| 5,974,607 | A | * | 11/1999 | Smith | 5/636 |
| 5,996,152 | A | * | 12/1999 | Wilson | 5/655 |
| 6,038,720 | A | | 3/2000 | Matthews et al. | 5/639 |
| 6,055,687 | A | | 5/2000 | Matthews | 5/636 |
| 6,088,854 | A | * | 7/2000 | Brownrigg | 5/632 |
| 6,119,873 | A | | 9/2000 | Matthews | 211/49.1 |
| 6,123,389 | A | | 9/2000 | O'Connor et al. | 297/397 |
| 6,161,239 | A | * | 12/2000 | Grazel | 5/655 |
| 6,279,185 | B1 | * | 8/2001 | Matthews | 5/655 |
| 6,412,127 | B1 | * | 7/2002 | Cuddy | 5/640 X |
| 6,412,128 | B1 | * | 7/2002 | Matthews | 5/655 |
| 6,449,788 | B1 | * | 9/2002 | Nichols | 5/636 |
| 6,457,195 | B1 | * | 10/2002 | Holste | 5/636 |
| 6,481,032 | B2 | * | 11/2002 | Milano et al. | 5/655 |
| 2002/0020021 | A1 | * | 2/2002 | Milano et al. | 5/655 |
| 2002/0029422 | A1 | * | 3/2002 | Matthews | 5/655 |
| 2002/0042953 | A1 | * | 4/2002 | Brown | 5/655 |

FOREIGN PATENT DOCUMENTS

| | | | | |
|---|---|---|---|---|
| DE | 4237792 A1 | * | 5/1993 | 5/655 |
| FR | 2379268 | | 9/1978 | |
| GB | 1508809 | | 4/1976 | |
| WO | WO 89/11264 | | 11/1989 | |

* cited by examiner

*Primary Examiner*—Robert G. Santos
(74) *Attorney, Agent, or Firm*—Fish & Richardson P.C.

(57) ABSTRACT

A nursing pillow has a flexible, positionable spine that allows the pillow to be deformed into a number of stable shapes. The spine is enclosed within a resilient body forming a medial region and first and second cantilever arms extending from opposite ends of the medial region to define a central opening between the arms in an unloaded, nominal shape. The spine is of sufficient stiffness to keep the pillow from returning from an adjusted shape to its nominal shape when unloaded. The spine may be formed of articulating links, or a malleable rod.

51 Claims, 5 Drawing Sheets

POSITIONABLE PILLOW

TECHNICAL FIELD

This invention relates generally to support pillows, and more particularly to pillows configured to support an infant, such as during nursing.

BACKGROUND

Some pillows are provided with a nominal shape suitable for their intended function. Many nursing pillows, for example, are horseshoe-shaped as shown in FIG. 1, defining a central well or aperture for placing the pillow about the abdomen of a mother. The pillow supports the weight of a nursing infant lying on a central or medial portion of the pillow, with arms of the pillow extending about the mother for comfort, support and pillow retention.

Improvements in the function and comfort of pillows, such as nursing pillows, are desired.

SUMMARY

According to one aspect of the invention, a pillow has a medial region and first and second cantilever arms extending from opposite ends of the medial region to define a central opening between the arms in an unloaded, nominal shape. The pillow includes a resilient body with an outer covering extending about the medial region and arms, the body being sufficiently flexible to allow the arms to be manually moved to adjust the pillow shape. The pillow also has a flexible spine extending across the medial region and into both arms. The spine is of sufficient stiffness to keep the pillow from returning from an adjusted shape to its nominal shape when unloaded.

Preferably the spine is enclosed within the body, although the spine can be fashioned to run along an outer edge of the medial region and arms, or be otherwise secured to the body.

In some embodiments, distal ends of the arms extend toward one another with the pillow in its nominal shape, such that a distance between the distal ends of the arms is less than a distance between the arms in a plane midway between the distal ends and the medial portion of the pillow. In some cases, the arms are repositionable to a stable position in which the distal ends of the arms extend away from each other, such that the arms are furthest apart at their distal ends. Furthermore, in some cases, the arms are repositionable to a stable position in which the arms are farther apart than in the nominal shape of the pillow, with the distal ends of the arms extending toward one another.

In some configurations, the arms generally lie in a common plane with the pillow in its nominal shape.

Preferably, the medial portion has a thickness, measured perpendicular to the common plane, of at least four inches, with the arms tapering in thickness from the medial portion to distal ends of the arms.

It is also preferable that the central opening be generally oval with the pillow in its nominal shape, for nursing applications, with the oval opening having a major axis extending from one arm of the pillow to the other arm.

In some constructions, the central opening has a maximum width, as measured between the arms, of about eleven inches, with the pillow in its nominal shape.

The maximum width of the opening as measured in the common plane, with the arms of the pillow repositioned to their closest stable position within the common plane, is preferably greater than about eight inches.

Various embodiments provide various adjustment modes. For example, in some cases, the arms are repositionable to a stable position with the arms extending out of the common plane. In some cases, the medial portion is repositionable to form a stable arch extending out of the common plane, as another example.

In many cases, the spine includes an articulated series of links, each link pivotably secured to at least one adjacent link to form a chain. In some instances, one link defines a socket sized to receive and retain a ball of a connecting link. The socket may be defined within a skirt of the one link, with the skirt having an inner rib positioned to engage a distal edge of the connecting link to limit angulation between the links, for example. Preferably, inter-link angulation is limited to an angle of less than about 30 degrees, as measured between central axes of adjacent links. It is also generally preferable that the series of links have a combined maximum angulation, as measured between central axes of end links of the series, of at least about 270 degrees.

In some embodiments, the spine includes a non-articulated, elongated central portion extending along the medial portion of the pillow, a first series of articulated links extending from one end of the central portion of the spine into one of the arms, and a second series of articulated links extending from the other end of the central portion of the spine into the other of the arms.

In some other embodiments, links of a central portion of the spine extending along the medial portion of the pillow are configured to have a maximum angulation between adjacent links that is less than a maximum angulation between adjacent links of an end portion of the spine disposed within one of the arms of the pillow.

In some cases, a central portion of the spine includes a first series of articulated links extending along the medial portion of the pillow, and ends of the spine each include an additional series of articulated links extending from one end of the central portion of the spine into one of the arms, with links in the arms articulable to form a greater curvature than those of the central portion. In such cases, it is preferable that links of the central portion of the spine be longer, as measured between adjacent link joint centers of rotation, than links in the arms of the pillow.

Preferably, the pillow is sized to fit securely about an abdomen of a nursing mother.

It is also preferable that the outer covering be of a washable fabric. In some cases, the pillow includes a removable outer cover extending about the covering.

According to another aspect of the invention, a method of nursing a child is provided. The method includes placing the above-described nursing pillow about an abdomen of an adult, adjusting the pillow to a desired, stable shape other than the nominal shape, placing an infant upon the medial portion of the pillow, and nursing the infant with the infant supported on the pillow.

In some embodiments, adjusting the pillow includes repositioning the arms of the pillow, such as to adjust the pillow for a desired fit about the abdomen of the adult. In some cases in which the arms generally lie in a common plane with the pillow in its nominal shape, repositioning the arms includes moving the arms out of their common plane.

In some cases in which the arms and medial portion of the pillow generally lie in a common plane with the pillow in its nominal shape, adjusting the pillow includes arching the medial portion out of the common plane.

In some cases in which the arms and medial portion of the pillow generally lie in a common plane with the pillow in its nominal shape, adjusting the pillow includes moving the arms within the common plane to alter the central opening.

Various aspects of the invention can provide increased flexibility and function with a nursing pillow, by giving the user a choice of shapes and adjustment. Various shape modifications can be perceived as benefiting the nursing process, either by making the mother or the infant more comfortable, or reducing apprehension that the infant may roll from the pillow during nursing. Adjustments may be performed to place the pillow in a stable shape suitable to fit comfortably about the mother's abdomen, for example.

Pillows constructed as disclosed herein are useful for purposes other than nursing infants. For example, such pillows may be useful for supporting infants or young children, or even older children or adults, in a sitting position between the pillow arms or reclining on the medial portion of the pillow. Although the shape of the illustrated embodiments is generally toroidal with distal ends of the arms slightly separated, other arm configurations or shapes are useful, particularly for non-nursing applications.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
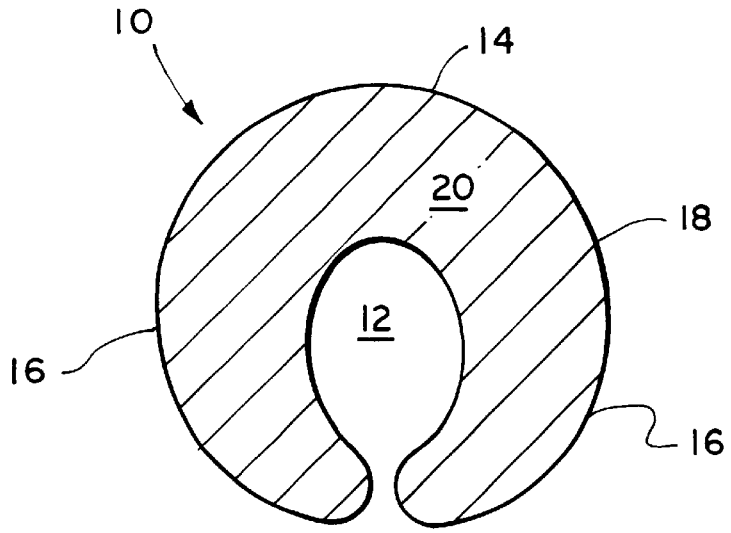
FIG. 1 PRIOR ART
FIG. 1 is a cross-sectional view showing the shape and construction of a prior art nursing pillow.

FIG. 1 shows a cross-section of a prior art, horseshoe-shaped nursing pillow 10, with a central well or aperture 12 for placing the pillow about the abdomen of a mother while nursing, for example. The pillow supports the weight of a nursing infant lying on a central or medial portion 14 of the pillow, with arms 16 of the pillow positioned to extend about the mother. Pillow 10 consists essentially of a cloth cover 18 sewn from upper and lower horseshoe-shaped pieces of fabric, stitched together about their mutual perimeter, and stuffed with a fiberfill, foam, or other type of batting material 20. Pillow 10 is shown in its relaxed, unloaded shape, although the cover 10 and fill 20 are sufficiently resilient to allow arms 16 to be forcibly separated for placing the pillow about a mother's abdomen. So separated, arms 16 will tend to return to their relaxed position, due to residual stress in the cover and/or fill.

Figure 2:
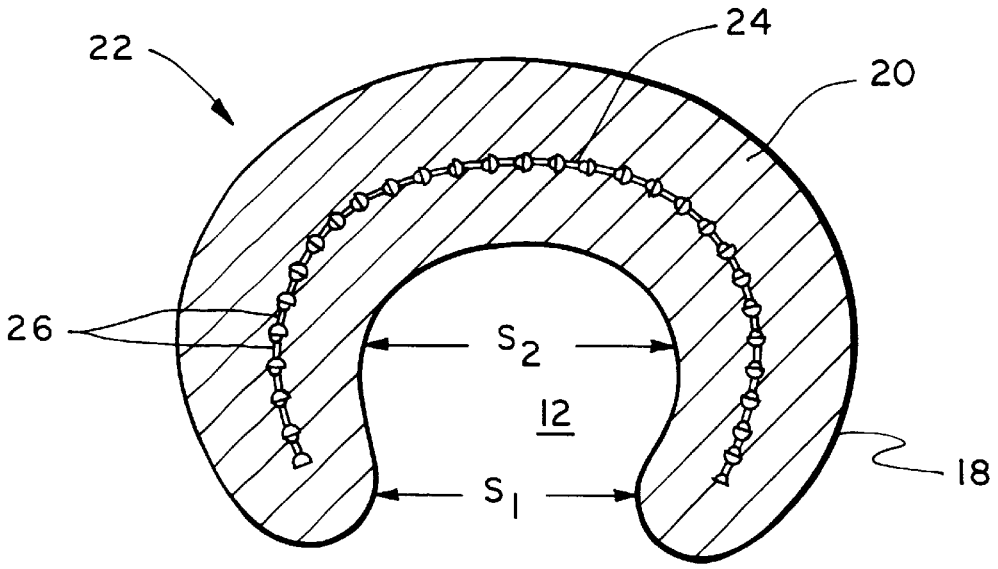
FIG. 2 is a cross-sectional view of a nursing pillow having a positionable, articulated spine.

Referring now to FIG. 2, pillow 22 also has a cloth cover 18, sewn from upper and lower horseshoe-shaped pieces of fabric stitched together about their mutual perimeter, and stuffed with a fiberfill, foam, or other type of batting material 20. Cover 18 may be of woven or non-woven construction from natural or synthetic fibers, and may be removable for cleaning. Fill 20 may be a molded, open cell polyester foam or a polyester fiberfill, for example. Pillow 22 also has an articulating spine 24 made up of a series of individual links 26. Spine 24 may be placed in any of a number of desired positions by forcibly moving the arms 16 and/or medial portion 14 of pillow 22 by hand. Once positioned as desired, spine 24 resists recovery of cover 18 and/or fill 20 to their relaxed state. Thus, although cover 18 tends to generally define the broad shape of the pillow, by its construction, cover 18 and fill 20 are resilient and flexible enough to allow modification of the pillow shape over a range, and once pillow 22 is placed out of its relaxed shape, spine 24 tends to maintain its adjusted shape until re-adjusted. In its nominal shape, as shown, distal ends 28 of the arms are separated by a distance $S_1$ that is less than a distance $S_2$ between arms 16 in a plane midway between the distal ends and the medial portion of the pillow. By "nominal shape" we mean the shape the cover and fill of the cover would naturally assume in the absence of spine 24 and any external deforming force. Preferably, in the nominal shape, well 12 is generally oval, with the dimension $S_2$ extending along its major axis, rather than oval with a major axis extending toward the gap between distal arm tips, as in the pillow of FIG. 1.

Figure 3:
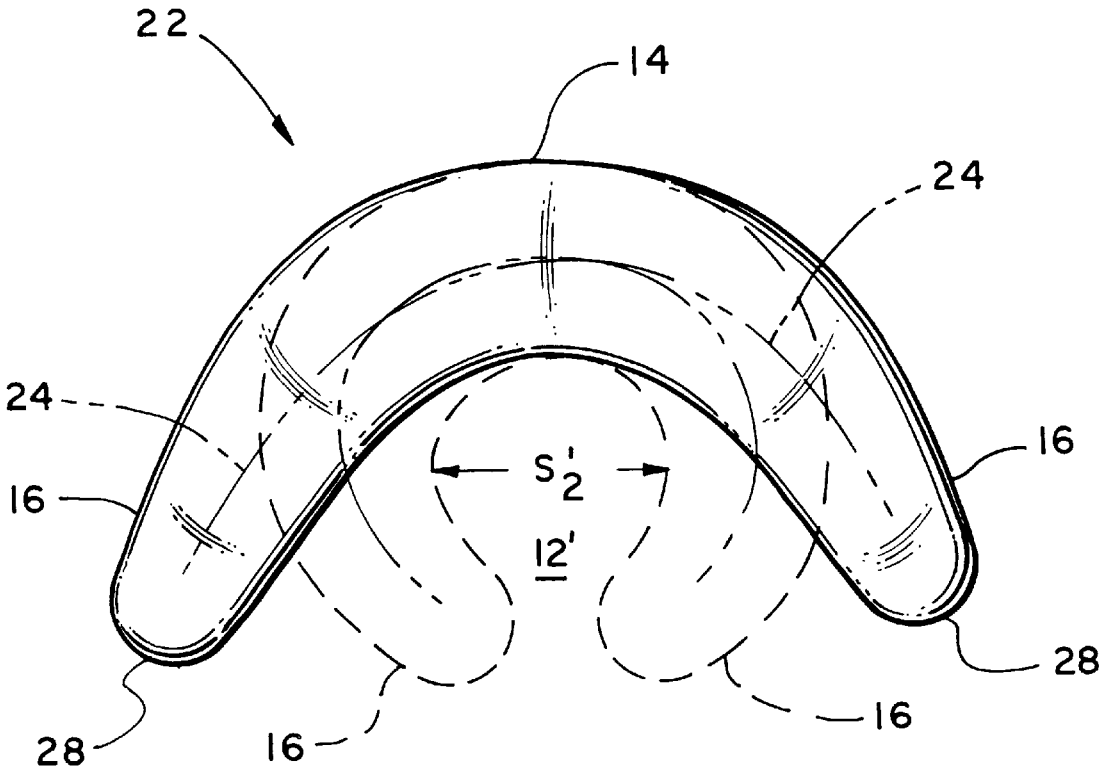
FIG. 3 shows a range of stable positions obtainable with the nursing pillow of FIG. 2.

FIG. 3 shows a range of stable shapes of the pillow of FIG. 2. By "stable shape" we mean a pillow shape maintained without continued presence of shape-deforming force. This does not mean that when forced to a given deformed shape pillow 22 will remain in exactly the deformed shape without some recovery, and the amount of recovery before obtaining a stable shape will depend to a great extent on the choice of materials and various design parameters. Notably, however, pillow 22 has a stable shape other than its nominal shape. In the extended position (shown in solid outline), the distal ends 28 of arms 16 no longer are directed toward one another, as in the naturally relaxed shape of cover 18 and in the closed position (shown in dashed outline). Instead, they are directed outward, such that the inner side of pillow 22 defines more of a depression 12' than a well. In the closed position, the maximum width $S_2'$ is preferably greater than about eight inches, and is about nine inches in this example. The range of adjustment illustrated in FIG. 3 is all within a plane within which pillow 22 forms its overall crescent shape, although other stable deformations are possible.

Figure 4:
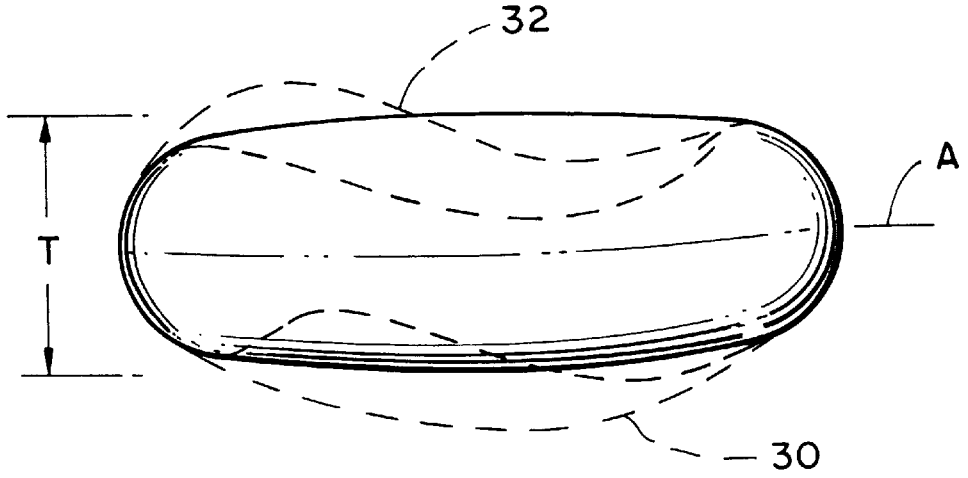
FIG. 4 is a side view of the pillow of FIG. 2, as viewed from the side to which the pillow arms extend, illustrating various stable positions of the pillow as adjusted out of its nominal plane.

FIG. 4, for example, shows in dashed outline a few deformations out of such a plane "A". In one extra-planar stable shape 30, medial portion 14 of the pillow is bowed downward, such that a majority of the spine in the medial portion lies below plane A. This forms a trough on the upper side of the pillow that may be more comfortable for some nursing infants. In another extra-planar shape 32, a left portion of the pillow rises above the horizontal plane, while a right portion of the pillow falls below. For some infants and mothers, such a shape may be preferable for slightly raising a nursing infant's head for improved suckling. The nominal thickness "T" of the medial portion of the pillow is about six inches, which in this example is about one-half the maximum lateral width of the well between the pillow arms, with the pillow in its nominal shape. As shown in other views, this thickness tapers in the arms of the pillow. The extra-planar shape adjustment illustrated in FIG. 4 is enabled by the three-dimensional range of motion of joints between individual links of the spine within the pillow.

Figure 5:
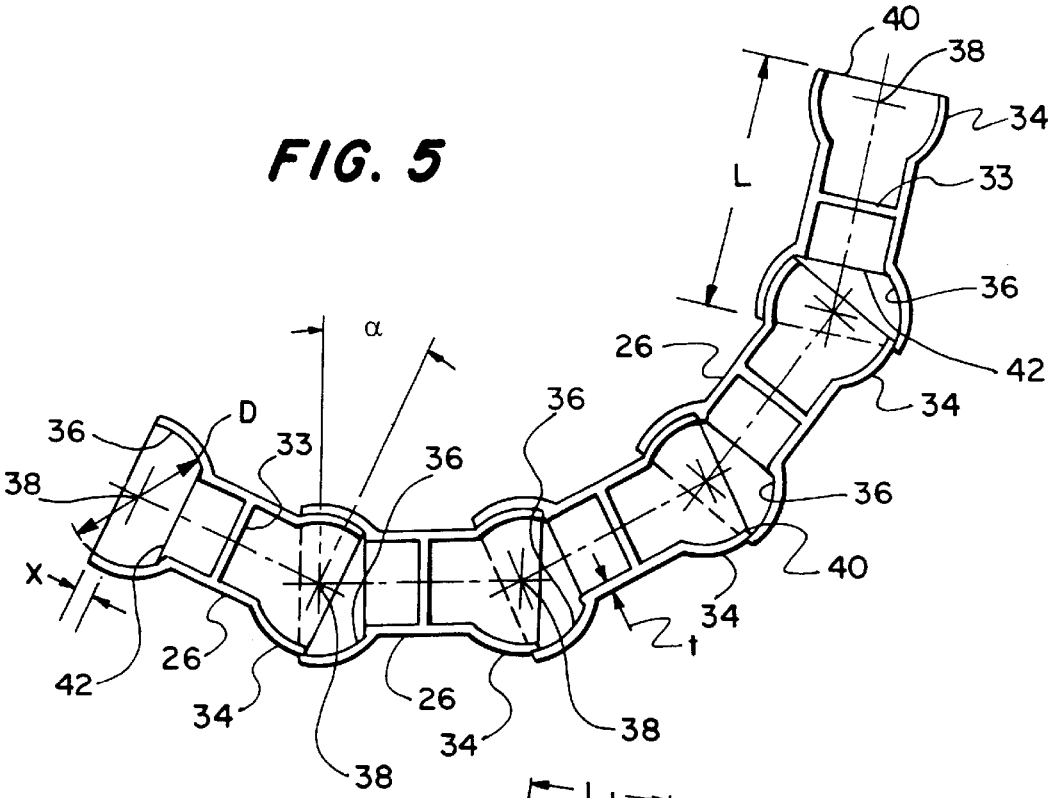
FIGS. 5 and 5A illustrate examples of spine and link features and articulation.

Referring now to FIG. 5, one preferred construction of the spine features individual links 26 molded of nylon or other hard plastic and connected by ball-and-socket joints. Links 26 are in the form of sleeves of nominal wall thickness "t" of about 0.06 to 0.08 inch, molded to have enlarged ends. Links 26 are hollow, save for a wall 33 across their centers. The outer surface at one end (the male end) of each sleeve forms a truncated, spherical surface 34 of approximately the same diameter "D" of about 0.88 inch as a truncated, spherical surface 36 defined by the inner surface of a skirt at the other end (the female end) of the sleeve. It will be understood that the tightness of the fit between the male surfaces and female surfaces will affect the stiffness of the resulting joint. The centers 38 of the spheres defined by the male and female sleeve surfaces 34, 36 are within the length "L" of each sleeve, a distance "X" of about 0.12 inch from the sleeve ends, such that when snapped together, male surfaces 34 are retained to pivot within female surfaces 36 to form a pivoting joint. The maximum articulation angle $\alpha$ at each joint is about 25 degrees in any given direction, as measured between central axes of adjacent links, and is limited by the interference of the distal lip 40 of each male sleeve end with a rib 42 at the base of the female receptacle of the connecting link.

Figure 5A:
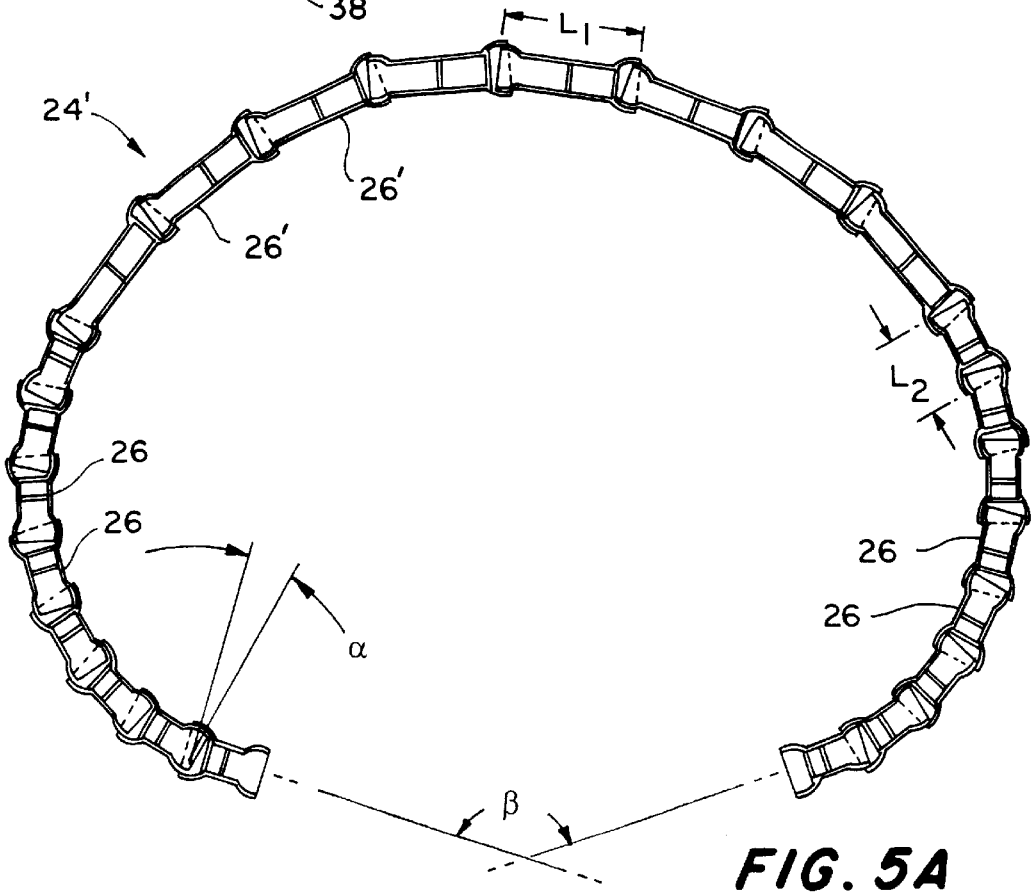

One present pillow construction has a spine illustrated in FIG. 5A, consisting of 24 such links, with eight links 26' in the medial portion of the pillow each having a length "$L_1$" of about 2.7 inches, and eight links 26 extending along each arm having individual lengths "$L_2$" of about 1.5 inches, such that the arms of the pillow are adjustable to a greater curvature than the medial portion. In this case, the maximum angulation angle $\alpha$ between adjacent links is only about 14 degrees, giving the overall spine, in the absence of the pillow fill and cover, an overall angulation $\beta$ of about 322 degrees between end links. An overall angulation of greater than 180 degrees enables the distal ends of the pillow to approach one another, and an overall angulation of greater than 270 degrees is preferred for elbow support while nursing. Another means of limiting curvature in the medial portion of the pillow is setting the maximum angulation of the central links to be lower than those of the arms.

Figure 6:
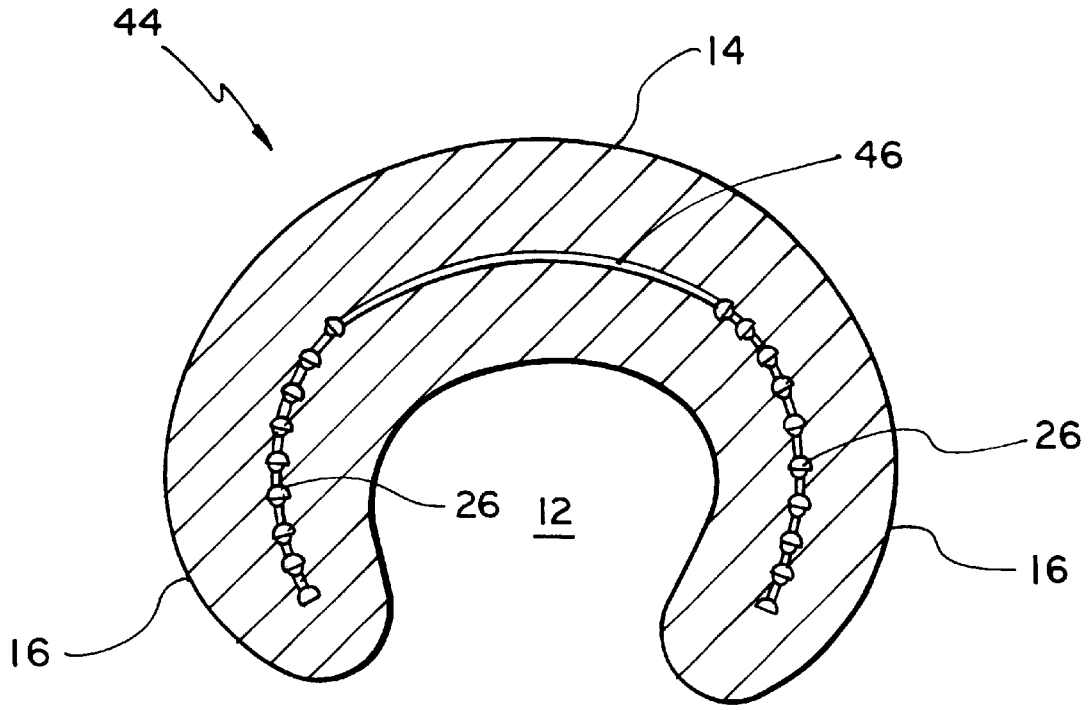
FIG. 6 illustrates an alternative spine having an inflexible central portion.

Referring now to FIG. 6, pillow 44 has a spine made up of a rigid medial portion 46 extending across the medial portion 14 of the pillow, with a series of articulated links 26 extending from each end, along the arms 16 of the pillow. Pillow 44 lacks the extent of extra-planar adjustability illustrated in FIG. 4, due to rigid spine portion 46, but it does maintain the arch of medial portion 14 as arms 16 are forcibly adjusted. Maintaining the shape of medial portion 14 has the advantage of keeping central well 12 from collapsing, and may offer enhanced comfort to some users along with arm adjustability. Such advantage is also obtained by forming a spine (not shown) with links of a central portion of the spine, extending along the medial portion of the pillow, being configured to have a maximum angulation between adjacent links that is less than a maximum angulation between adjacent links of end portions of the spine disposed within the arms of the pillow.

Figure 7:
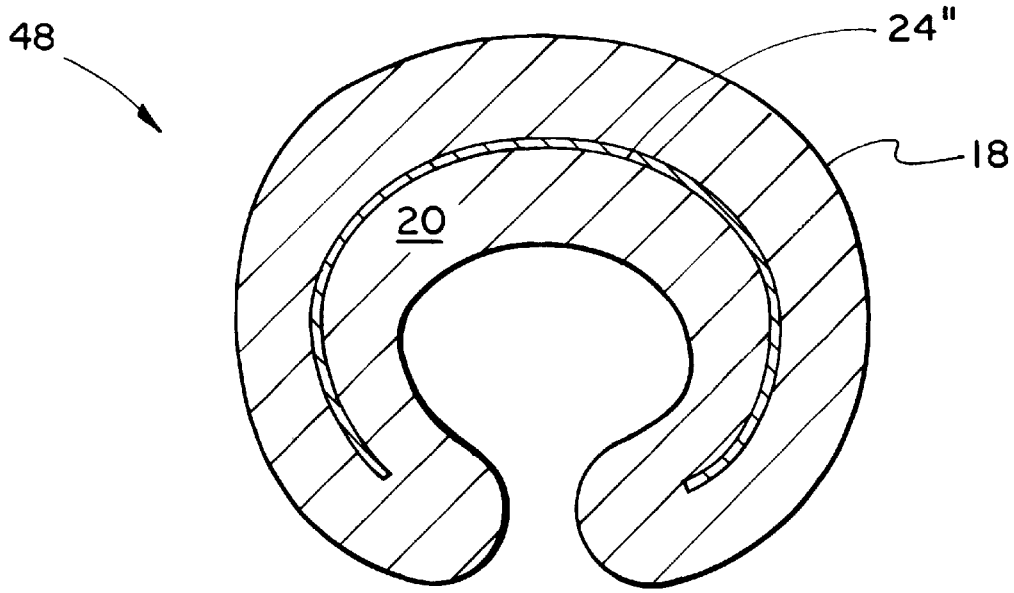
FIG. 7 is a cross-sectional view of a nursing pillow having a different spine construction.

Other articulating spine constructions (not shown) feature connected segments with other types of movable joints. For example, the types of joints found in flexible, metal ducts and pipes also enable shape adjustment with little shape memory. In another example, shown in FIG. 7, pillow 48 has a spine 24" not comprised of individual, articulating links, but of a single length of spiral-wound sheath, such as is known to be used for encasing wiring within walls of a building. Friction between the overlapping wraps of the helix acts to resist recovery of the pillow when moved from its nominal shape. In another example (not shown), the pillow spine is a rod of malleable material.

Figure 8:
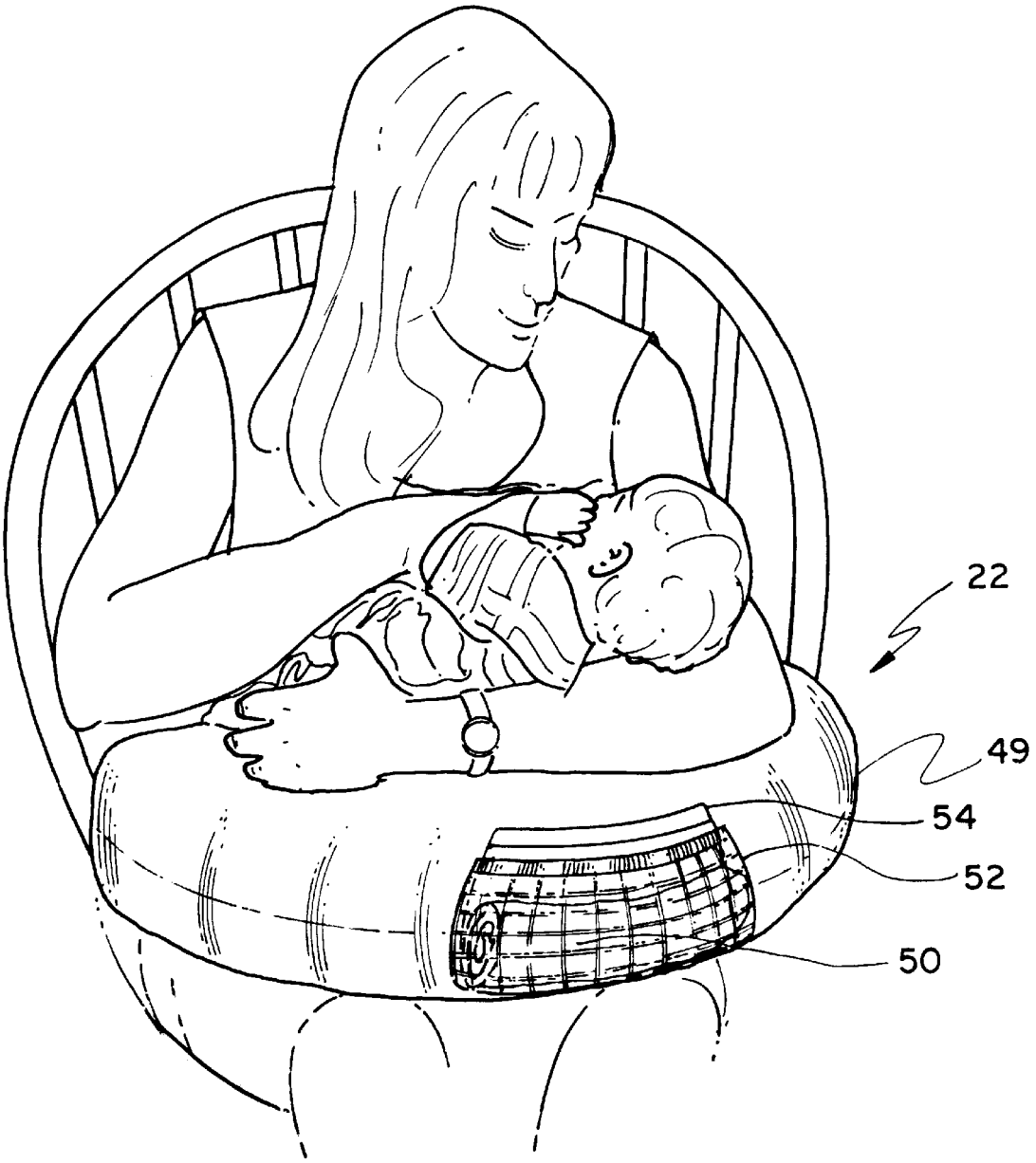
FIG. 8 illustrates the adjustable nursing pillow of FIG. 2, in use.

FIG. 8 shows the pillow 22 of FIG. 2 adjusted to a stable shape about the waist of a nursing mother, and covered with a removable fabric cover 49, secured about the pillow such as with a zipper closure (not shown). One method of adjusting the covered pillow is to extend the arms of the pillow to open up the center well, place the pillow arms about the user's waist, and then to press the pillow arms in toward the user's sides for a comfortable fit. Because fit and retention are not necessarily dependent on pillow resiliency, the pillow need not be constructed to have a relaxed cover shape that uncomfortably presses in on the user's sides during use. FIG. 8 also shows a nursing cover or blanket 50 rolled up and stowed in a net pocket 52 on a back side of the pillow and removably attached at one end to the pillow cover with a length of touch fastener 54. For discrete nursing in public, blanket 50 may be unrolled and draped over the nursing infant and adjacent shoulder of the mother while attached at a lower end to the pillow.

A number of embodiments of the invention have been described. Nevertheless, it will be understood that various modifications may be made without departing from the spirit and scope of the invention. Accordingly, other embodiments are within the scope of the following claims.

What is claimed is:

1. A pillow having a medial region and first and second cantilever arms extending from opposite ends of the medial region to define a central opening between the arms in an unloaded, nominal shape, the pillow comprising a resilient body with a covering extending about the medial region and arms, the body being sufficiently flexible to allow the arms to be manually moved to adjust the pillow shape; and a flexible spine comprising an articulated series of links, each link pivotably secured to at least one adjacent link to form a chain extending across the medial region and into both arms, the spine of sufficient stiffness to keep the pillow from returning from an adjusted shape to its nominal shape when unloaded.

2. The pillow of claim 1 wherein distal ends of the arms extend toward one another with the pillow in its nominal shape, such that a distance between the distal ends of the arms is less than a distance between the arms in a plane midway between the distal ends and the medial portion of the pillow.

3. The pillow of claim 2 wherein the arms are repositionable to a stable position in which the distal ends of the arms extend away from each other, such that the arms are furthest apart at their distal ends.

4. The pillow of claim 2 wherein the arms are repositionable to a stable position in which the arms are farther apart than in the nominal shape of the pillow, with the distal ends of the arms extending toward one another.

5. The pillow of claim 1 wherein the arms generally lie in a common plane with the pillow in its nominal shape.

6. The pillow of claim 1 wherein the medial portion has a thickness, measured perpendicular to the common plane, of at least four inches.

7. The pillow of claim 1 wherein the opening is generally oval with the pillow in its nominal shape.

8. The pillow of claim 7 wherein the oval opening has a major axis extending from one arm of the pillow to the other arm.

9. The pillow of claim 1 wherein the opening has a maximum width, as measured between the arms, of about eleven inches, with the pillow in its nominal shape.

10. The pillow of claim 1 in which the arms generally lie in a common plane with the pillow, wherein the maximum width of the opening as measured in the common plane, with the arms of the pillow repositioned to their closest stable position within the common plane, is greater than about eight inches.

11. The pillow of claim 10 wherein the arms are repositionable to a stable position with the arms extending out of the common plane.

12. The pillow of claim 10 wherein the medial portion is repositionable to form a stable arch extending out of the common plane.

13. The pillow of claim 1 wherein the arms taper in thickness from the medial portion to distal ends of the arms.

14. The pillow of claim 1 wherein one link defines a socket sized to receive and retain a ball of a connecting link.

15. The pillow of claim 14 wherein the socket is defined within a skirt of said one link, the skirt having an inner rib positioned to engage a distal edge of the connecting link to limit angulation between the links.

16. The pillow of claim 1 wherein inter-link angulation is limited to an angle of less than about 30 degrees, as measured between central axes of adjacent links.

17. The pillow of claim 1 wherein the series of links has a combined maximum angulation, as measured between central axes of end links of the series, of at least about 270 degrees.

18. The pillow of claim 1 wherein the spine comprises a non-articulated, elongated central portion extending along the medial portion of the pillow, a first series of articulated links extending from one end of the central portion of the spine down one of the arms, and a second series of articulated links extending from the other end of the central portion of the spine down the other of the arms.

19. The pillow of claim 18 wherein links of a central portion of the spine extending along the medial portion of the pillow are configured to have a maximum angulation between adjacent links that is less than a maximum angulation between adjacent links of an end portion of the spine along one of the arms of the pillow.

20. The pillow of claim 1 wherein a central portion of the spine comprises a first series of articulated links extending along the medial portion of the pillow, and ends of the spine each comprise an additional series of articulated links extending from one end of the central portion of the spine down one of the arms, links in the arms articulable to form a greater curvature than those of the central portion.

21. The pillow of claim 20 wherein the links of the central portion of the spine are longer, as measured between adjacent link joint centers of rotation, than links along the arms of the pillow.

22. The pillow of claim 1 sized to fit securely about an abdomen of a nursing mother.

23. The pillow of claim 1 wherein the covering is a washable fabric.

24. The pillow of claim 1 further comprising a removable outer cover extending about the covering.

25. The pillow of claim 1 wherein the spine is enclosed within the body.

26. A method of nursing a child, the method comprising placing a nursing pillow about an abdomen of an adult, the pillow having a medial region and first and second cantilever arms extending from opposite ends of the medial region to define a central opening between the arms in an unloaded, nominal shape, the pillow comprising a resilient body with a covering extending about the medial region and arms, the body being sufficiently flexible to allow the arms to be manually moved to adjust the pillow shape; and a flexible spine extending across the medial region and into both arms, the spine of sufficient stiffness to keep the pillow from returning from an adjusted shape to its nominal shape when unloaded;

adjusting the pillow to a desired, stable shape other than the nominal shape;

placing an infant upon the medial portion of the pillow; and nursing the infant with the infant supported on the pillow.

27. The method of claim 26 wherein adjusting the pillow includes repositioning the arms of the pillow.

28. The method of claim 27 wherein repositioning the arms includes adjusting the pillow for a desired fit about the abdomen of the adult.

29. The method of claim 27 wherein the arms generally lie in a common plane with the pillow in its nominal shape, and wherein repositioning the arms includes moving the arms out of their common plane.

30. The method of claim 26 wherein the arms and medial portion of the pillow generally lie in a common plane with the pillow in its nominal shape, and wherein adjusting the pillow includes arching the medial portion out of the common plane.

31. The method of claim 26 wherein the arms and medial portion of the pillow generally lie in a common plane with the pillow in its nominal shape, and wherein adjusting the pillow includes moving the arms within the common plane to alter the central opening.

32. A pillow having a medial region and first and second cantilever arms extending from opposite ends of the medial region to define a central opening between the arms in an unloaded, nominal shape, the pillow comprising a resilient body with a covering extending about the medial region and arms, the body being sufficiently flexible to allow the arms to be manually moved to adjust the pillow shape; and a flexible spine comprising an articulated series of links, each link pivotably secured to at least one adjacent link to form a chain extending across the medial region and into both arms, the spine of sufficient stiffness to keep the pillow from returning from an adjusted shape to its nominal shape when unloaded;

wherein the spine comprises a non-articulated, elongated central portion extending along the medial portion of the pillow, a first series of articulated links extending from one end of the central portion of the spine down one of the arms, and a second series of articulated links extending from the other end of the central portion of the spine down the other of the arms.

33. The pillow of claim 32 wherein distal ends of the arms extend toward one another with the pillow in its nominal shape, such that a distance between the distal ends of the arms is less than a distance between the arms in a plane midway between the distal ends and the medial portion of the pillow.

34. The pillow of claim 33 wherein the arms are repositionable to a stable position in which the distal ends of the arms extend away from each other, such that the arms are furthest apart at their distal ends.

35. The pillow of claim 33 wherein the arms are repositionable to a stable position in which the arms are farther apart than in the nominal shape of the pillow, with the distal ends of the arms extending toward one another.

36. The pillow of claim 32 wherein the arms are repositionable to a stable position with the arms extending out of a common plane with the pillow.

37. The pillow of claim 32 wherein the medial portion is repositionable to form a stable arch extending out of a common plane with the pillow.

38. The pillow of claim 32 wherein one link defines a socket sized to receive and retain a ball of a connecting link.

39. The pillow of claim 38 wherein the socket is defined within a skirt of said one link, the skirt having an inner rib positioned to engage a distal edge of the connecting link to limit angulation between the links.

40. The pillow of claim 32 wherein the series of links has a combined maximum angulation, as measured between central axes of end links of the series, of at least about 270 degrees.

41. The pillow of claim 32 wherein links of a central portion of the spine extending along the medial portion of the pillow are configured to have a maximum angulation between adjacent links that is less than a maximum angulation between adjacent links of an end portion of the spine along one of the arms of the pillow.

42. A pillow having a medial region and first and second cantilever arms extending from opposite ends of the medial region to define a central opening between the arms in an unloaded, nominal shape, the pillow comprising a resilient body with a covering extending about the medial region and arms, the body being sufficiently flexible to allow the arms to be manually moved to adjust the pillow shape; and a flexible spine comprising an articulated series of links, each link pivotably secured to at least one adjacent link to form a chain extending across the medial region and into both arms, the spine of sufficient stiffness to keep the pillow from returning from an adjusted shape to its nominal shape when unloaded;

wherein a central portion of the spine comprises a first series of articulated links extending along the medial portion of the pillow, and ends of the spine each comprise an additional series of articulated links extending from one end of the central portion of the spine down one of the arms, links in the arms articulable to form a greater curvature than those of the central portion.

43. The pillow of claim 42 wherein distal ends of the arms extend toward one another with the pillow in its nominal shape, such that a distance between the distal ends of the arms is less than a distance between the arms in a plane midway between the distal ends and the medial portion of the pillow.

44. The pillow of claim 43 wherein the arms are repositionable to a stable position in which the distal ends of the arms extend away from each other, such that the arms are furthest apart at their distal ends.

45. The pillow of claim 43 wherein the arms are repositionable to a stable position in which the arms are farther apart than in the nominal shape of the pillow, with the distal ends of the arms extending toward one another.

46. The pillow of claim 42 wherein the arms are repositionable to a stable position with the arms extending out of a common plane with the pillow.

47. The pillow of claim 42 wherein the medial portion is repositionable to form a stable arch extending out of a common plane with the pillow.

48. The pillow of claim 42 wherein one link defines a socket sized to receive and retain a ball of a connecting link.

49. The pillow of claim 48 wherein the socket is defined within a skirt of said one link, the skirt having an inner rib positioned to engage a distal edge of the connecting link to limit angulation between the links.

50. The pillow of claim 42 wherein the series of links has a combined maximum angulation, as measured between central axes of end links of the series, of at least about 270 degrees.

51. The pillow of claim 42 wherein the links of the central portion of the spine are longer, as measured between adjacent link joint centers of rotation, than links along the arms of the pillow.

* * * * *